US006843885B2

(12) United States Patent
Gustavsson et al.

(10) Patent No.: US 6,843,885 B2
(45) Date of Patent: Jan. 18, 2005

(54) METHOD FOR CONTROLLING THE COOKING TEMPERATURE IN A CONTINUOUS VAPOUR PHASE DIGESTER

(75) Inventors: Lennart Gustavsson, Karlstad (SE); Vidar Snekkenes, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 409 days.

(21) Appl. No.: 10/168,826

(22) PCT Filed: Dec. 21, 2000

(86) PCT No.: PCT/SE00/02635

§ 371 (c)(1),
(2), (4) Date: Jun. 19, 2002

(87) PCT Pub. No.: WO01/49927

PCT Pub. Date: Jul. 12, 2001

(65) Prior Publication Data

US 2003/0000660 A1 Jan. 2, 2003

(30) Foreign Application Priority Data

Dec. 29, 1999 (SE) ..... 9904847

(51) Int. Cl.[7] ..... D21C 3/00; D21C 11/00

(52) U.S. Cl. ..... 162/29; 162/52; 162/61; 162/68

(58) Field of Search ..... 162/19, 49, 61, 162/52, 237, 238, 239, 242, 29, 39, 250, 68

(56) References Cited

U.S. PATENT DOCUMENTS 3,881,986 A * 5/1975 Backlund ..... 162/19
5,401,361 A * 3/1995 Prough et al. ..... 162/17
5,635,025 A * 6/1997 Bilodeau ..... 162/17
5,882,477 A * 3/1999 Laakso et al. ..... 162/63

FOREIGN PATENT DOCUMENTS

EP 0670925 * 12/1997 ..... D21C/7/14

* cited by examiner

*Primary Examiner*—Steven P. Griffin
*Assistant Examiner*—Kara M. Parker
(74) *Attorney, Agent, or Firm*—Rolf Fasth; Fasth Law Offices

(57) ABSTRACT

The method is for controlling the cooking temperature in a continuous vapour phase digester for chip-shaped cellulose material. A high pressure is established in the vapour phase largely by means of steam, without risk of attaining excessively high temperatures in the cooking. A temperature-controlled supply of cooking liquor in close proximity to the surface of the liquor level is introduced to obtain a protective liquor surface with a temperature lower than the vapour phase. A lower initial cooking temperature is obtained in the cooking zone, which ensures that the exothermic cooking process does not lead to the attainment of temperatures detrimental to the pulp quality.

14 Claims, 3 Drawing Sheets

METHOD FOR CONTROLLING THE COOKING TEMPERATURE IN A CONTINUOUS VAPOUR PHASE DIGESTER

PRIOR APPLICATION

This application is a U.S. national phase application based on International Application No. PCT/SE00/02635, filed 21 Dec. 2000.

STATE OF THE ART

In the operation of continuous digesters for pulping cellulose fibres from chopped chips there are a number of parameters that must be optimized in order that the cellulose pulp obtained will have the desired characteristics.

Conventionally the digesters are run with continuous drawing-off of used cooking liquor and the addition of new cooking liquor as the pulp sinks down through the digester. During this addition there is thus also a need to achieve the correct temperature, which often means that heating must be applied to the cooking liquor that is delivered. When using vapour phase digesters it is also advantageous for the vapour phase to be pressurized to a level such that cooking in the liquor is suppressed.

In certain applications cooling of the delivered cooking liquor is also required, primarily with the aim of avoiding so-called "hammering" by the vapour in the feed lines. The main purpose of the cooling is precisely to avoid these often very loud knockings in the feed lines, most commonly in the top circulation of the digesters. EP670925 granted patent protection to this art known from the mid nineteen-fifties. The cooling effect supplied is limited so that hammering does not occur in the feed lines. In these embodiments cooling in its self is not actually desirable for the actual cooking process, since the cooking process conversely normally requires additional heat so that the required cooking temperature is achieved. The problem of "hammering" is described in "*The History of Kamyr Continuous Cooking*" by Johan Richter (published in 1981). Examples of suitable cooling methods were installed in the nineteen-fifties at Sudbrook Mill in southern England, where cooling jackets were installed both around the feed line from the high-pressure choke to the top of the digester and on the return line from the top take-off back to the inlet feed system. These cooling jackets are quite discernible on the operating control panel shown in the book "*Sudbrook Mill*" published by W. S. Cowell Ltd, Oct. 1, 1958. Also in this system, two heat exchangers are also used to heat up circulating liquor at intermediate levels in the digester.

A system in which the aim has been to lower the temperature inside the digester has hitherto not been applied from the cooking point of view. In all previous cooking liquor cooling applications this has been done with a view to avoiding "hammering" or abrupt pressure relief, so-called "flashing", when pressurized hot cooking liquor is fed to unpressurized parts of the system such as storage tanks etc. Cooling has only been used in order to cope with specific problems, which must be viewed in the light of the fact that the entire cooking process is a very energy-intensive process, which requires additional heat and in which there is a desire to minimize energy consumption.

In the operation of continuous digesters, especially pin chip digesters, it has proved highly advantageous to have relatively high pressure in the vapour phase. This means that a more uniform degree of packing is obtained over the full height of the digester, that is to say also at the top of the digester, and also a better degree of packing over the entire cross-section of the digester. A more advantageous plug flow down through the digester is thereby obtained, as a result of which a higher and more uniform pulp quality can be achieved. One problem with pin chip digesters is that a very rapid exothermic reaction occurs at the start of cooking, mainly in co-current cooking, in which substantially all white liquor is added right at the top of the digester.

A conventional method of creating these high pressures is to add large quantities of air at the top of the digester. This addition of air has proved to have serious disadvantages, however, in the form of foaming when pressure is relieved by the drawing-off of pressurized cooking liquor, and prevents effective deaeration from the chip pocket in the feed system to the digester. Another disadvantage with the addition of air lies in the need to invest in a costly air supply system, which is capable of delivering the requisite quantities of air to the pressurized level of the vapour phase.

Another method is to increase the quantity of steam that is fed to the top of the digester. This means that the temperature also follows suit, since the feed temperature of the steam increases proportionally with the pressure. Thus at high pressures the temperature also increases, which means that high temperatures are initially attained that are not conducive to the cooking process. In order to avoid the pulped mass having too low a brightness and low viscosity at these high temperatures, it is essential to reduce the input of alkali to the digester, at least initially, which means that the slushed pulp instead has too high a kappa number, that is to say too much lining remains in the pulp that leaves the digester, since the lignin is not dissolved during the cooking.

BRIEF DESCRIPTION OF THE INVENTION

One object of the present invention is to overcome the disadvantages of known cooking processes in which vapour phase digesters are used and to obtain an improved cooking process in which better and more uniform pulp quality can be achieved.

A further object is to obtain an improved plug flow through the entire digester, without the problem of foaming occurring when pressure is relieved from hot, pressurized cooking liquor.

A further object is to be able to adjust the actual cooking process to an initial optimum cooking temperature, regardless of whether very high pressures prevail in the vapour phase in the digester.

Yet another object of the method is to facilitate the creation of an upper liquor surface on the liquor level, which can protect the chips from excessive temperatures during the actual cooking, despite the fact that the temperature in the vapour phase above the liquor surface has a temperature many degrees higher. In order to obtain this protective liquor surface the flow of temperature-controlled liquor must be of a substantial quantity. In this way the exothermic cooking process can be protected from reaching top temperatures detrimental to the pulp, which excessive temperatures result in drastic deterioration both of the brightness and of the viscosity.

In an advantageous application in the cooking of pin chips, it is possible to improve control of the often very rapid temperature rises that initially occur in the cooking zone. The pin chips with their predominating fine material fraction result in a significantly larger surface being exposed to the cooking liquor, which leads to acceleration of the chemical/exothermic process and a more rapid temperature increase.

The invention is thereby advantageously applied in pin chip digesters with co-current cooking (that is where the liquor has the same flow downwards through the digester as the chips), and especially in pin chip digesters in which substantially all white liquor/alkali is added at the top of the digester.

BRIEF DESCRIPTION OF FIGURES

The invention will be described below with reference to the figures, of which.

DETAILED DESCRIPTION OF FIGURES

Figure 1:
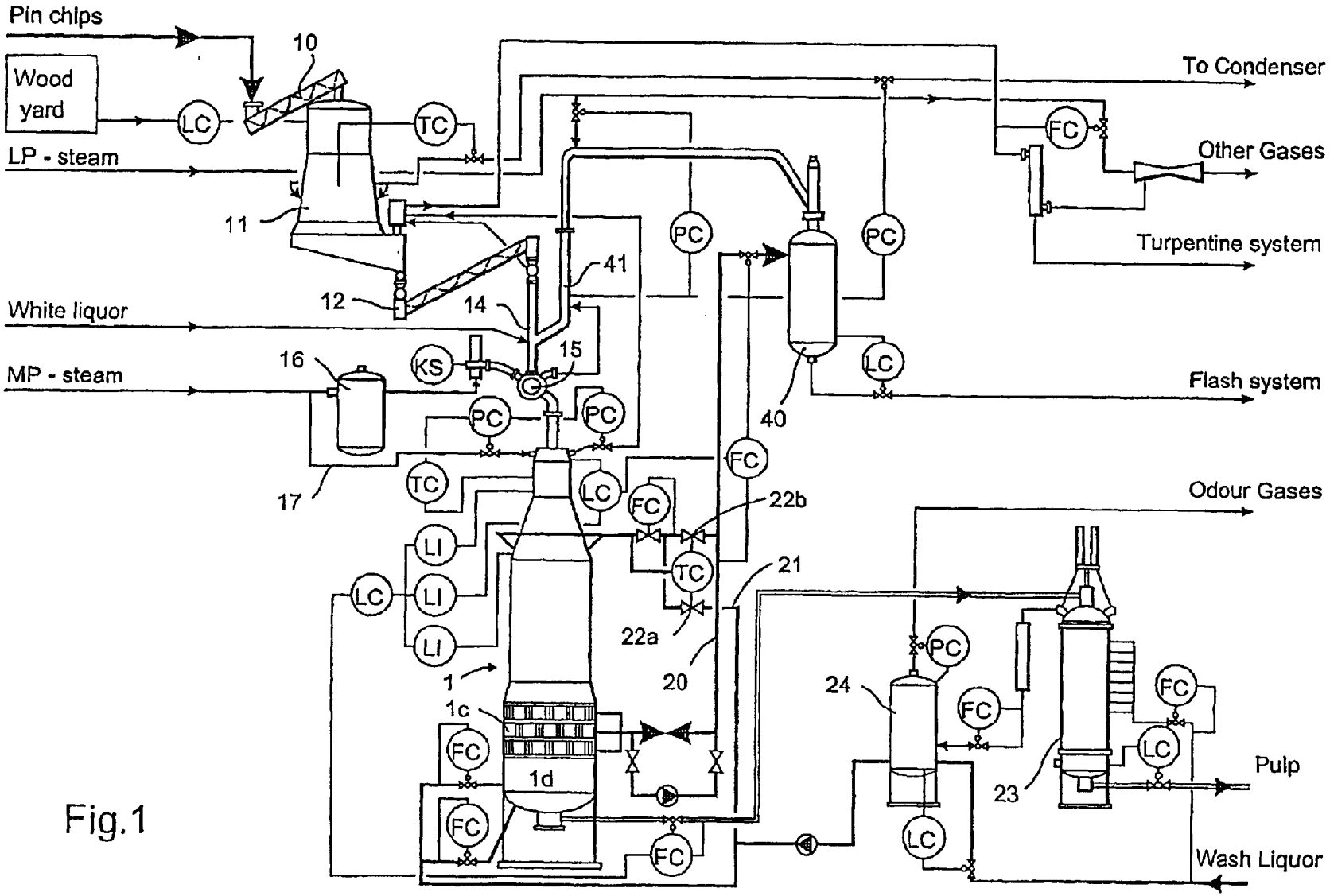
FIG. 1 shows an overview of the system for continuous cooking of cellulose chips, in this case a pin chip digester.

FIG. 1 shows a system according to the invention for continuous cooking of cellulose chips, in this case a pin chip digester 1. The pin chips are first fed by an inclined screw 10 to a chip silo 11, where the chips are steamed with steam. From the bottom of the chip silo 11 the chips are conveyed to a chute 14, via a feed screw 12 and a low pressure choke (chip sluice) The figure shows that the pin chips are mixed with white liquor in the chute 14, but the white liquor can often also be fed in beforehand in the feed screw 12, so that it manages to penetrate/impregnate the chips sufficiently.

In the bottom part of the chute 14 a sluice feeder 15 of known type, also called an "asthma choke" (or by the English designation "rotary feeder") is arranged, in which a pocket in the sluice feeder is filled from the chute, following which the pocket is indexed/rotated through 30–45 degrees so that the bottom part of the pocket is exposed to the top of the digester while the upper part of the pocket is exposed to a steam feed line. The sluice feeder 15 is thereby in a position in which steam can blow the chips present in the pocket down to the top of the digester, and when the steam is turned on the chips are blown down into the digester, which gives the characteristic sound that gives the sluice feeder its name "asthma choke".

The supply of steam is obtained from the pulp mill's production of medium pressure (MP) steam, and a steam accumulator 16 is arranged directly upstream of the sluice feeder, viewed in the steam direction of flow. The medium pressure steam conventionally maintains a pressure level of 3–5 bar overpressure.

In order to fully guarantee that the correct pressure level can be established at the top of the vapour phase digester, there is also a direct supply feed to the top of the digester via the line 17.

FIG. 1 also shows a pressure relief tank 40, and pressure relief line 41, into which the sluice feeder relieves the pressure in the pocket before subsequent filling of the pocket from the chute 14.

In cooking the chips in the digester 1, therefore, the aim is to achieve a liquor/chips ratio in the order of 3.5–6 kg of liquor per kg of chips, preferably 4–5 kg of liquor per kg of chips, the weight of the chips being calculated in a bone-dry condition. The "bone dry" condition corresponds to the term "absolutely dry" and exhibits a significantly lower moisture content than pulp in the "air-dried" condition.

In the system in question in FIG. 1 the supply of liquor/chips is controlled by the sluice feeder in such a way that only a proportion of all the liquor required for cooking is supplied from the sluice feeder 15, appropriately so that the liquor/chips ratio in the liquor-mixed chips fed in with steam contains 40–70% of the liquor required for cooking in the digester, and even more preferably less than 60% of the proportion of liquor needed for cooking.

Figure 2:
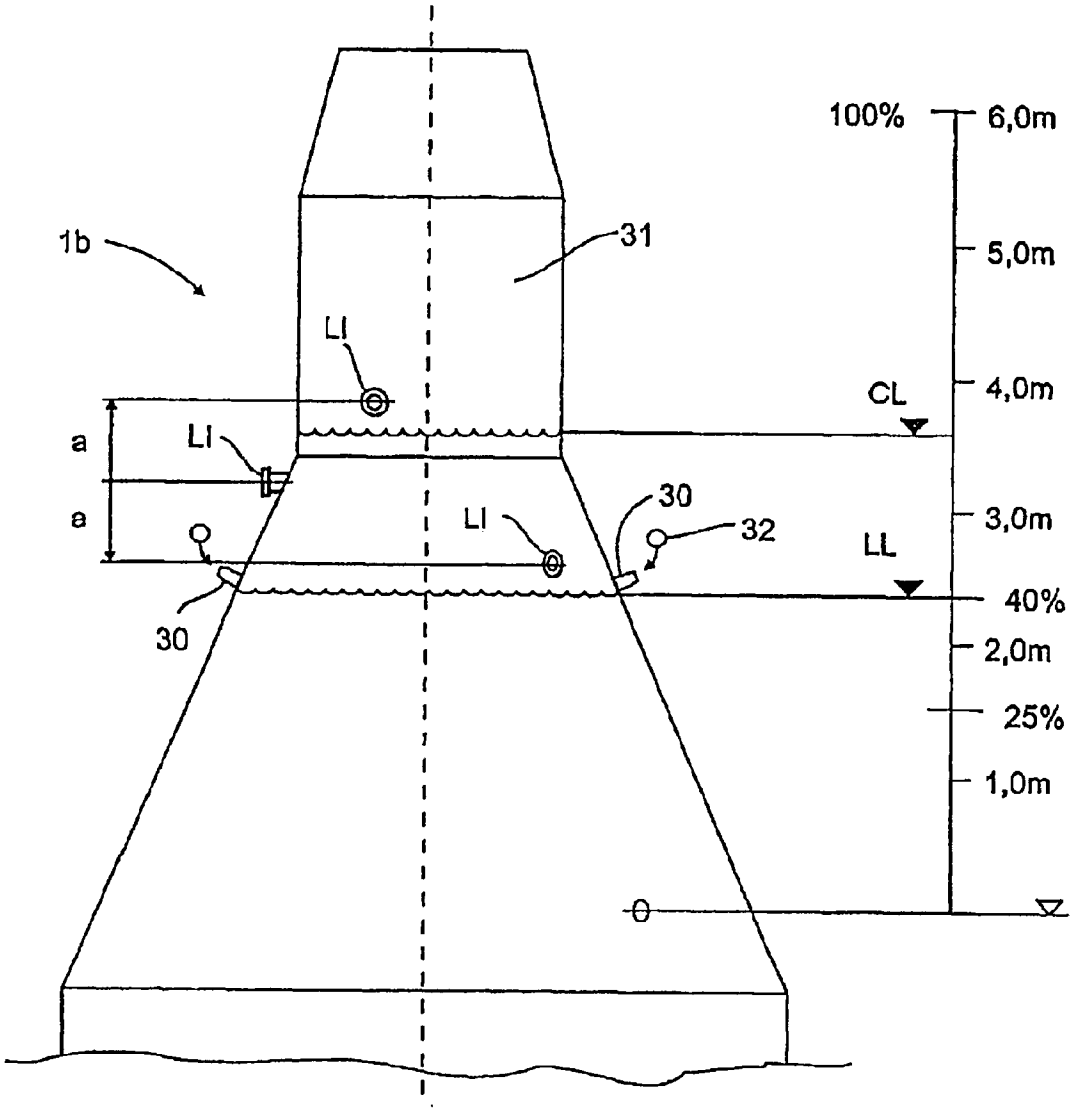
FIG. 2 shows a diagram of the upper part of the pin chip digester in FIG. 1.

When the chips and the liquor from the sluice feeder 15 are deposited in the top 1*b* of the vapour phase digester a level with chips and a level with liquor are formed, the set levels of which govern the delivery of material and are shown in FIG. 2 by the level markings CL (Chip level) and LL (Liquor level) respectively.

In the vapour phase digester in question the top-up filling zone constitutes an area that extends 6 metres from the top. The degree of filling of cooking liquor, that is the level LL, is detected by way of a suitable liquor riser pipe connected at the 0-level. The current set level for the liquor is typically situated around 40% calculated from the bottom of the top-up filling zone. The degree of filling is detected by means of a chip level indicator (LI), a number of chip level indicators preferably being arranged at the interval a from one another in the height direction and distributed over the circumference. The said chip level indicators are of conventional type, with an arm fixed to a torsion bar that is acted upon by overlying chips. The moment to which the torsion bar is subjected then becomes a measure of the current chip height above the indicator. The current set level for the chips is typically situated around 60–65% calculated from the bottom of the top-up filling zone.

In order that the current set level for the cooking liquor will be attained, a temperature-controlled flow of cooking liquor is also fed in by way of the nozzle 30 according to the invention in close proximity to the liquor set level.

In order to achieve a uniform degree of packing even at the top 1*b* of the digester and a well formed plug flow during the movement of the chips down through the digester, the pressure in the vapour phase 31 must be kept as high as possible. In the system according to the invention this pressure is largely obtained solely through the supply of steam, the temperature also being correspondingly high in the vapour phase.

The supply of steam largely through the sluice feeder is therefore controlled in such a way that the steam pressure in the vapour phase exceeds 3 bar overpressure and so that the temperature there exceeds 140° C., preferably 5.5 bar overpressure and a temperature in the range 158–163° C.

The necessary steam is in the main supplied by way of the sluice feeder, but if more steam is required this can be supplied via a direct feed to the top of the digester by way of the line 17. In normal operation therefore, only modest additional amounts of steam need to be fed in via the line 17, well under 10% of the total steam demand.

In this way the requisite steam pressure is developed, which gives the design degree of packing and the design plug flow. The temperature is far too high, however, for the remaining cooking process to result in an acceptable pulp quality, since the exothermic process during cooking entails a temperature increase of at least 2–10° C., preferably 5–80° C. in relation to the initial temperature in the vapour phase. Nor has the correct liquor/chip ratio been established that is required so that the correct quantity of digesting chemicals will be present throughout the cooking process and so that a well-designed flow down through the digester will result without any risk of sticking.

In order to ensure that the correct liquor/chip ratio is established, in the range 3.5–6 kg of liquor per kg of chips, preferably 4–5 kg of liquor per kg of chips, the weight of the chips being calculated in the bone-dry condition, further cooking liquor is delivered in close proximity to the target set level LL for liquor in the digester.

According to the invention the temperature of the said cooking liquor must be adjusted to a level at least 2° C., preferably at least 5° C., below the current temperature level in the vapour phase, and be of a quantity such that the temperature at the liquor surface adjoining the vapour phase is essentially subject to a substantial temperature reduction. The requisite quantity of temperature-controlled cooking liquor is controlled in such a way that the said quantity is equal to 30–60% of the quantity of cooking liquor that is required for cooking, preferably at least 40% and in an advantageous embodiment of the pin chip digester shown about 44%.

The liquors which form the cooking liquor in the vessel are made up partly of moisture contained in the chips, added white liquor and the added, temperature-controlled black liquor mixture. In a preferred application in cooking in a pin chip digester shown in FIG. 1, the moisture content in the chips is equal to 10.3 litres, the white liquor 5.7 litres and the temperature-controlled black liquor 12 litres, in operation with a liquor/chips ratio in the range of 4–5 kg liquor per kg of chips.

The temperature of the cooking liquor is preferably adjusted by means of temperature-controlled mixing of the hot cooking liquor that is drawn off from the bottom of the digester, and cooled cooking liquor obtained from cooking liquor drawn off from stages downstream of the digester. This variant is shown in FIG. 1, in which cooking liquor 20 is drawn off from the digester, at the end of digester zone 1*c* and before the washing zone 1*d*, the said hot cooking liquor being mixed with return cooking liquor 21 obtained from the washing or displacement stages downstream of the digester. In FIG. 1 the said return cooking liquor is obtained from downstream pressure diffuser 23 by way of an intermediate storage tank 24 for the cooking liquor displaced from the pressure diffuser. Mixing to the temperature-controlled level is done with a flow control, reconnected as a function of the temperature and labelled TC in the figure, from the secondary flows 20 and 21 with the control valves 22*a* and 22*b* respectively.

The hot cooking liquor 20 that is drawn off from the bottom of the digester normally maintains a temperature that is at least 4–10° C., preferably 5–8° C., higher than the temperature in the delivery zone for the temperature-controlled cooking liquor. This is as a result of the exothermic reaction from the cooking in the white liquor. With an initial temperature at the start of the cooking zone of approx. 155° C. a discharge cooling liquor temperature in the order of 162° C. or higher is obtained.

In FIG. 1 general temperature control elements are indicated by the designation TC. LC denotes Level Control, PC denotes Pressure Control and FC denotes Flow Control.

The return cooking liquor 21 from washing or displacement stages downstream of the digester normally maintains a temperature that is considerably lower than the cooking liquor that is drawn off directly from the bottom of the digester, and typically lies in the range 90–105° C. A temperature control by mixing cooking liquors obtained in the process, which naturally assume different temperatures without active cooling, means that the energy consumption is not unnecessarily high, as would otherwise result from active cooling in a process that otherwise requires additional heat.

In certain installations, however, a directly or indirectly acting heat exchanger can be used, in which, for example, the hot cooking liquor discharged from the bottom is cooled down before it is returned as temperature-controlled cooking liquor in proximity to the liquor set level.

The temperature-controlled cooling liquor is preferably to be deposited in the digester immediately below the target set level for the liquor, so that the high temperature in the vapour phase does not result in direct vaporization or temperature increase of the temperature-controlled cooking liquor. Since the chip level is adjusted to a set level CL situated above the liquor level, however, the temperature-controlled cooking liquor can be deposited in the digester immediately above the target set level LL for the liquor. Delivering the temperature-controlled cooking liquor inside the packed chips means that the chips to some extent protect the temperature-controlled cooking liquor from being heated up too rapidly in the vapour phase.

It has been shown that the temperature-controlled cooking liquor can be fed to the digester on a level with the liquor level established in the digester, which level is situated in an area that extends from

- a maximum of 20% of the digester diameter above the liquor set level to
- a maximum of 50% of the digester diameter below the liquor set level.

It will of course be appreciated that a connection of the temperature-controlled cooking liquor situated as close to the liquor set level LL as possible is most advantageous, but that the liquor can be delivered inside the ranges specified without detriment to the object of establishing a protective liquor surface with a temperature substantially reduced in relation to the vapour phase.

Figure 4:
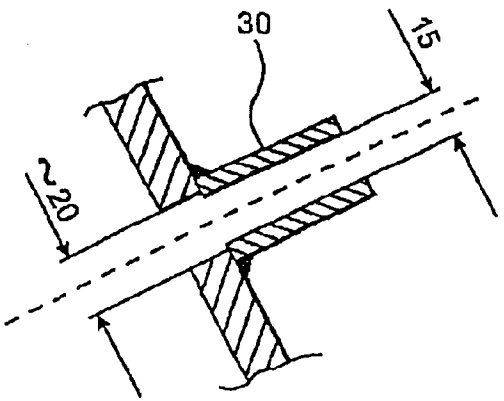
FIG. 4 shows a nozzle for the admission of temperature-controlled cooking liquor.
Figure 3:
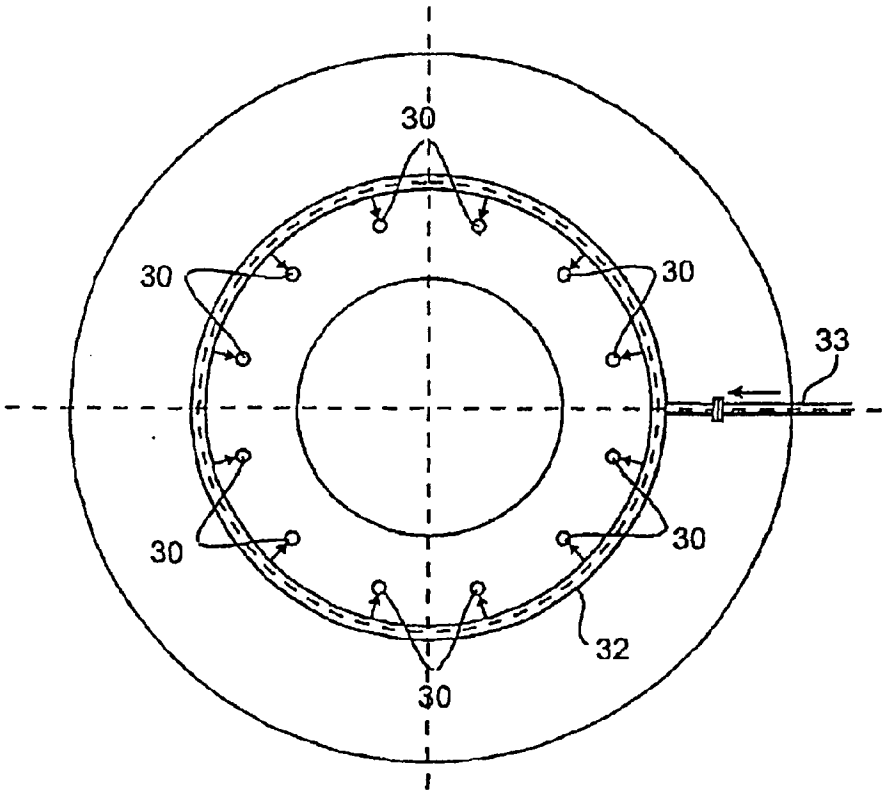
FIG. 3 shows a cross-section of FIG. 2 at the admission level of the temperature-controlled cooking liquor.

In order to obtain a proper temperature-controlled liquor surface over the entire cross section of the digester the temperature-controlled cooking liquor must be added to the digester by means of a plurality of inlet nozzles 30 distributed over the circumference of the digester, the inlet nozzles preferably totalling at least 8 to 14 in number. FIG. 3 shows 12 inlet nozzles 30, which are supplied with temperature-controlled cooking liquor from the feed line 33 by way of a distribution pipe 32 arranged around the top of the digester. Thus the said nozzles 30, when fitted above the target liquor level LL, as shown in FIG. 4, can be angled so that the outlet is directed obliquely down and into the digester towards the current set level for the liquor.

In the embodiment shown in FIG. 1 the current liquor level is monitored by an upper and lower liquor level sensor, connected to the right of the top of the digester and marked LC in the figure. The current chip level is monitored by three chip level sensors, connected to the left of the top of the digester and marked LI in the figure.

The method according to the invention is especially suitable for implementation on pin chip digesters, where pin chips smaller in size than conventional chips are used. The term "pin chips" is taken to mean chips that have been obtained after sorting out from chopped chips. For conventional cooking chips of a standardized size are used, which must not be so small that radial discharge of cooking liquor from the digester is impeded due to clogging. The pin chips are the counterpart of the reject that is obtained after sorting out fine material from chopped chips. Pin chips normally contain insignificant quantities of fractions in excess of the 8-mm chip thickness, where the 8–45-mm fraction and above is less than a few per cent.

The pin chips may therefore typically contain the following fraction percentages:

| Chip thickness, millimeters | % fraction |
|---|---|
| >45 | 0 |
| 8–45 | 0 |
| 7–8 | 66.9 |
| 3–7 | 27.2 |
| <3 | 5.9 |

In certain applications not only the proportion of sawdust in the pin chips, the fraction <3 mm, but also the 3–7 mm fraction may be considerably greater.

In the case of standard chips for conventional digesters the 8–45 mm and >45 fractions are therefore of significant size, most commonly in the range 6–20% for the 8–45 mm fraction and up to 10–15% for the >45 mm fraction.

When the pin chips are exposed to the cooking liquor a very rapid temperature increase therefore occurs. This is caused due to the fact that the pin chips have a very large surface exposed to the cooking liquor, which gives a very rapid temperature increase even at a very early stage in the cooking process due to the exothermic process. This makes it even more essential to be able to cool the cooking liquor down initially in the cooking zone.

In cooking pin chips, radial discharge of cooking liquor in intermediate zones of the digester is employed only in exceptional instances, and in the main all cooking liquor is initially supplied by the digester and only drawn off at the end of cooking, so-called co-current cooking. For a reliable plug flow through the digester it is therefore important in this respect that high pressurization can be established in the vapour phase without the disadvantages that normally occur with foaming (when air is added) or higher proportions of residual lignin after cooking (due to reduction of the alkali input). However, the invention is not confined in its application just to pin chip digesters, but can also be implemented in connection with conventional digesters.

By means of the method according to the invention an overpressure in excess of 3 bar can be obtained in the vapour phase, without reaching excessively high cooking temperatures during cooking. The overpressure in the vapour phase can be increased to levels of around 6 to 7 bar or more, where the measured temperature for steam at 6 bar overpressure, for example, corresponds to 165° C., and for 7 bar over pressure to 170° C. The need for cooling of the temperature-controlled cooking liquor added at the liquor set level then increases to a corresponding degree, so that a desired initial cooking temperature is obtained in the cooking zone. In this way greater degrees of freedom are achieved in optimizing the process accordingly as the cooking conditions change.

We claim:

1. A method for controlling the cooking temperature in a continuous vapor phase digester for chip-shaped cellulose material, comprising:

feeding chips and a cooking liquor to a top of the digester; establishing a chip level at the top of the digester; establishing a liquor level in a vapor phase below the chip level;

mixing the chips with the cooking liquor and feeding the mixture into the top of the digester by means of steam in a sluice device, the steam having a steam pressure in the vapor phase exceeding 3 bar overpressure and a temperature exceeding 140° C., the mixture containing 40–70% of a cooking quantity of the cooking liquor required for cooking in the digester; feeding a temperature-controlled quantity of cooking liquor to the digester at the liquor level established in the digester, the quantity of the temperature-controlled cooking liquor being 30–60% of the cooking quantity for cooking, the temperature of the temperature-controlled cooking liquor being adjusted to a temperature at least 2° C. below a temperature in the vapor phase;

cooking the chips in the digester with a liquor/chip ratio in a range of 3.5–6 kilogram of liquor per kilogram of chips; and withdrawing pulped cellulose fibers at a bottom of the digester.

2. The method according to claim 1 wherein the method further comprises adjusting a cooking temperature in the digester by means of a temperature-controlled mixing of a hot cooking liquor drawn off from the bottom of the digester and a cooled cooking liquor obtained from a cooking liquor drawn off from stages downstream of the digester.

3. The method according to claim 1 wherein the method further comprises situating the level of the temperature-controlled cooking liquor in an area of the digester extending from of 20% of a diameter of the digester above the liquor level to a maximum of 50% of the diameter of the digester below the liquor level.

4. The method according to claim 3 wherein the method further comprises feeding the temperature-controlled cooking liquor and a quantity of cooking liquor entrained in the chips to a liquor level situated about 3–4 meters below the top of the digester and adjusting a chip level to a level that is situated at least one meter above the liquor level.

5. The method according to claim 1 wherein the method further comprises adding the temperature-controlled cooking liquor to the digester by means of a plurality of inlet nozzles distributed over a circumference of the digester.

6. The method according to claim 1 wherein the method further comprises providing a quantity of the temperature-controlled cooking liquor that represents 40%–60% of the cooking quantity of cooking liquor required for cooking.

7. The method according to claim 1 wherein the method further comprises feeding a wash liquor to the bottom of the digester and maintaining a digester temperature by an exothermic reaction from a cooking process.

8. The method according to claim 1 wherein the method further comprises providing the chips with unsorted pin chips.

9. The method according to claim 1 wherein the method further comprises cooking the chips in the digester with a liquor/chip ratio in a range of 4–5 kilogram of liquor per kilogram of chips.

10. The method according to claim 1 wherein the method further comprises increasing the steam pressure to a 5.5 bar overpressure.

11. The method according to claim 1 wherein the method further comprises providing the steam with a temperature in the range of 158–163° C.

12. The method according to claim 1 wherein the method further comprises adjusting the temperature of the temperature-controlled cooking liquor to a temperature that is at least 5° C. below the temperature in the vapor phase.

13. A method for controlling the cooking temperature in a continuous vapor phase digester for chip-shaped cellulose material, comprising:

feeding chips and a cooking liquor to a top of the digester; establishing a chip level at the top of the digester; establishing a liquor level below the chip level and a vapor zone at the top of the digester, the vapor zone having a vapor zone temperature;

mixing the chips with the cooking liquor and feeding the mixture into the top of the digester by steam having a steam pressure exceeding 3 bar overpressure and a temperature exceeding 140° C., the mixture containing 40–70% of a cooking quantity of the cooking liquor required for cooking in the digester;

withdrawing a quantity of a temperature-controlled cooking liquor from a position downstream of the digester; feeding the quantity of the temperature-controlled quantity of cooking liquor to the digester at the liquor level, the quantity of the temperature-controlled cooking liquor being 30–60% of the cooking quantity for cooking;

adjusting a temperature of the temperature-controlled cooking liquor to a temperature at least 2° C. below the vapor zone temperature;

cooking the chips in the digester; and withdrawing pulped cellulose fibers at a bottom of the digester.

14. The method according to claim 13 wherein the method further comprises mixing the temperature-controlled cooking liquor with a black liquor withdrawn from the bottom of the digester.

* * * * *